US007025629B2

(12) United States Patent
Behr et al.

(10) Patent No.: US 7,025,629 B2
(45) Date of Patent: Apr. 11, 2006

(54) LAMP BASE FOR A HIGH-PRESSURE DISCHARGE LAMP AND HIGH-PRESSURE DISCHARGE LAMP

(75) Inventors: Gerhard Behr, Altheim (DE); Matthias Burkhardt, Hohenbrunn (DE); Peter Helbig, Sontheim (DE); Arnulf Rupp, Taufkirchen (DE)

(73) Assignee: Patent-Treuhand-Gesellschaft für elecktrische Gluhlampen mbH, Munich (DE)

( * ) Notice: Subject to any disclaimer, the term of this patent is extended or adjusted under 35 U.S.C. 154(b) by 0 days.

(21) Appl. No.: 10/919,410

(22) Filed: Aug. 17, 2004

(65) Prior Publication Data

US 2005/0062393 A1 Mar. 24, 2005

(30) Foreign Application Priority Data

Aug. 26, 2003 (DE) ..... 103 39 594

(51) Int. Cl.
*H01R 13/73* (2006.01)

(52) U.S. Cl. ..... 439/571; 439/79; 439/74

(58) Field of Classification Search ..... 439/571, 439/79, 74, 66, 619, 699.2
See application file for complete search history.

(56) References Cited

U.S. PATENT DOCUMENTS

| | | | | |
|---|---|---|---|---|
| 2,820,209 | A * | 1/1958 | Whitted | 439/571 |
| 4,664,458 | A * | 5/1987 | Worth | 439/82 |
| 5,173,062 | A | 12/1992 | Uchida | |
| 5,230,638 | A * | 7/1993 | DiViesti | 439/567 |
| 5,366,389 | A * | 11/1994 | Kreutter | 439/571 |
| 5,482,474 | A * | 1/1996 | Yohn et al. | 439/79 |
| 5,542,860 | A * | 8/1996 | Bandura et al. | 439/567 |
| 5,709,557 | A * | 1/1998 | Martin et al. | 439/79 |
| 5,797,757 | A * | 8/1998 | Aoki | 439/101 |
| 6,059,580 | A * | 5/2000 | Konno et al. | 439/74 |
| 6,238,219 | B1 * | 5/2001 | Wu | 439/74 |
| 6,364,515 | B1 | 4/2002 | Daub | |
| 6,379,176 | B1 * | 4/2002 | Ohsawa et al. | 439/495 |
| 6,733,306 | B1 * | 5/2004 | Kane et al. | 439/79 |
| 6,863,542 | B1 * | 3/2005 | Miyashita | 439/74 |

FOREIGN PATENT DOCUMENTS

| | | |
|---|---|---|
| EP | 1 189 314 A1 | 3/2002 |
| WO | 00/59269 | 10/2000 |

* cited by examiner

*Primary Examiner*—Gary F. Paumen
(74) *Attorney, Agent, or Firm*—William E. Meyer

(57) ABSTRACT

The invention relates to a lamp base for a high-pressure discharge lamp and to a high-pressure discharge lamp having a mounting plate for electronic modules and having a plug socket for connecting a voltage source to the lamp base, the plug socket being in the form of a surface-mounted module on the mounting plate.

1 Claim, 3 Drawing Sheets

LAMP BASE FOR A HIGH-PRESSURE DISCHARGE LAMP AND HIGH-PRESSURE DISCHARGE LAMP

I. TECHNICAL FIELD

Figure 1:
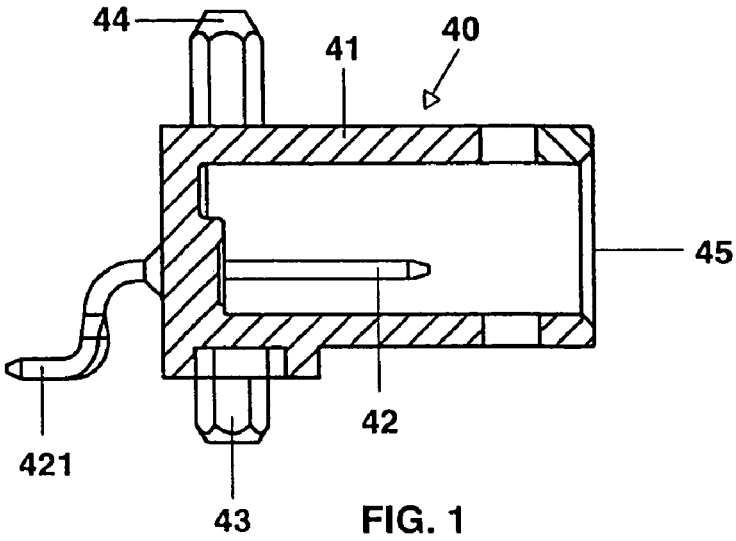

The invention relates to a lamp base for a high-pressure discharge lamp having a mounting plate for electronic modules and having a plug socket for connecting a voltage source to the lamp base, and to a high-pressure discharge lamp.

II. BACKGROUND ART

Such a lamp base and such a high-pressure discharge lamp are disclosed, for example, in the laid-open specification WO 00/59269. This specification describes a high-pressure discharge lamp having a lamp base, which comprises a plastic base outer part which is provided with a plug socket for supplying a voltage to the high-pressure discharge lamp. The housing of the plug socket is formed as part of the base outer part. As a result, when mounting the base, contact must be made between the metallic contact pins of the plug socket and the electrical modules of the high-pressure discharge lamp which are arranged in the lamp base.

III. DISCLOSURE OF THE INVENTION

It is the object of the invention to provide a lamp base for a high-pressure discharge lamp and a high-pressure discharge lamp having improved electrical terminals.

This object is achieved according to the invention by a lamp base for a high-pressure discharge lamp having a mounting plate for electronic modules and having a plug socket for connecting a voltage source to the lamp base, wherein said plug socket is in the form of a surface-mounted module on said mounting plate. Particularly advantageous embodiments of the invention are described in the dependent patent claims.

The lamp base according to the invention has a mounting plate for electronic modules, these modules preferably being the electronic modules of a starting apparatus for a high-pressure discharge lamp, and a plug socket for connecting a voltage source to the lamp base, in accordance with the invention the plug socket being in the form of a surface-mounted module on the mounting plate. This measure makes it possible for the prefabricated plug socket to be mounted on the mounting plate together with the other electronic modules, even before the base is mounted, in order then to insert the mounting plate, which has all of its modules fitted to it, into the lamp base. This makes it easier to mount the lamp base or the high-pressure discharge lamp. In addition, this makes it possible for the housing of the plug socket to be integral and for plastic injection molding to be used in an advantageous manner for the housing, in order to inject the metallic contact pins of the plug socket into said housing. The metallic contact pins of the plug socket are thereby embedded and fixed in the material of the plug socket housing.

The plug socket is advantageously fixed by means of first pins which are integral with the housing, produced by plastic injection molding, of the plug socket, and which engage in matching recesses in the mounting plate. For the purpose of fixing the module comprising the mounting plate and the plug socket fixed on said mounting plate to the lamp base, second pins are integrally formed on the plug socket housing and engage in matching recesses in a wall of the lamp base.

The first and second pins ensure that the tension and pressure on the metallic contact pins of the plug socket which are soldered to the conductor tracks of the mounting plate are relieved when a plug is inserted into and removed from the plug socket. The abovementioned pins are preferably in the form of hexagon or octagon pins, and the recesses which are matched to said pins preferably have a circular-cylindrical geometry, making a plug connection possible. This design ensures a clamping fit of the pins in the recesses, with the result that further measures for fixing the plug socket to the mounting plate or to the lamp base are superfluous.

The high-pressure discharge lamp according to the invention has a lamp base and a mounting plate arranged in said lamp base for electronic modules, which are preferably components of the starting apparatus for the high-pressure discharge lamp, and a plug socket for connecting a voltage source to the high-pressure discharge lamp, in accordance with the invention the plug socket being in the form of a surface-mounted module on the mounting plate. As has already been mentioned above, this measure makes it possible for the prefabricated plug socket to be mounted on the mounting plate together with the other electronic components, even before the base is mounted, in order then to insert the mounting plate, which has all of its modules fitted to it, into the lamp base of the high-pressure discharge lamp. This makes it easier to mount the high-pressure discharge lamp.

The lamp base of the high-pressure discharge lamp according to the invention preferably has the same advantageous features as have already been described above in connection with the lamp base according to the invention. The invention may advantageously be applied to high-pressure discharge lamps having a starting apparatus which is integrated in the lamp base, in particular to high-pressure discharge lamps for vehicle headlamps.

IV. BRIEF DESCRIPTION OF THE DRAWINGS

Figure 2:
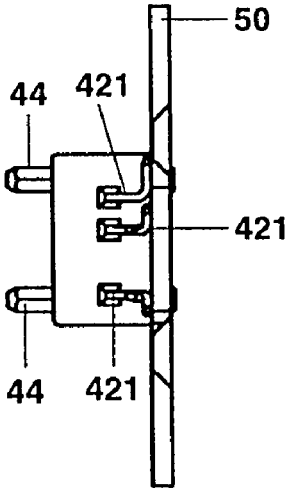
Figure 3:
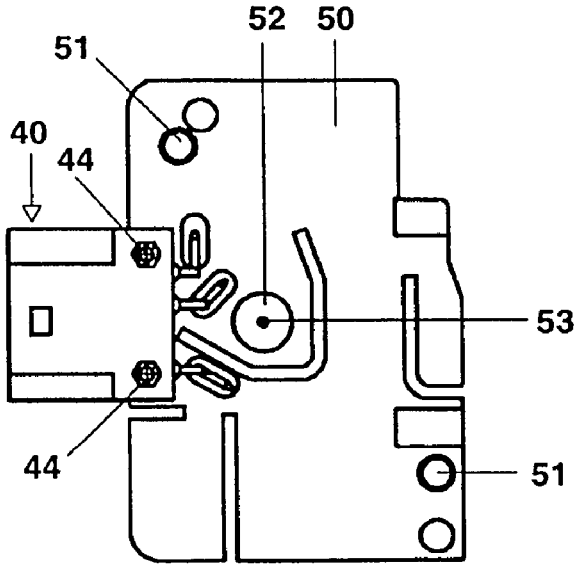
Figure 4:
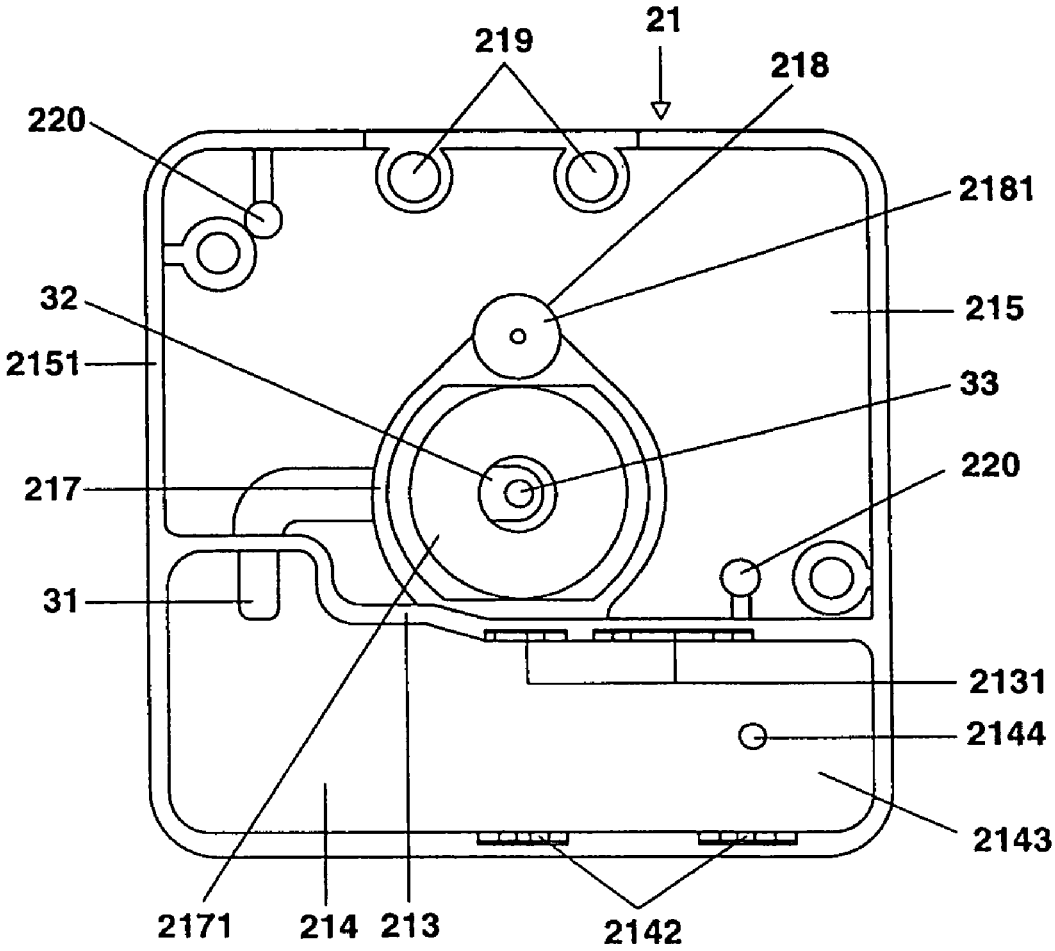
Figure 5:
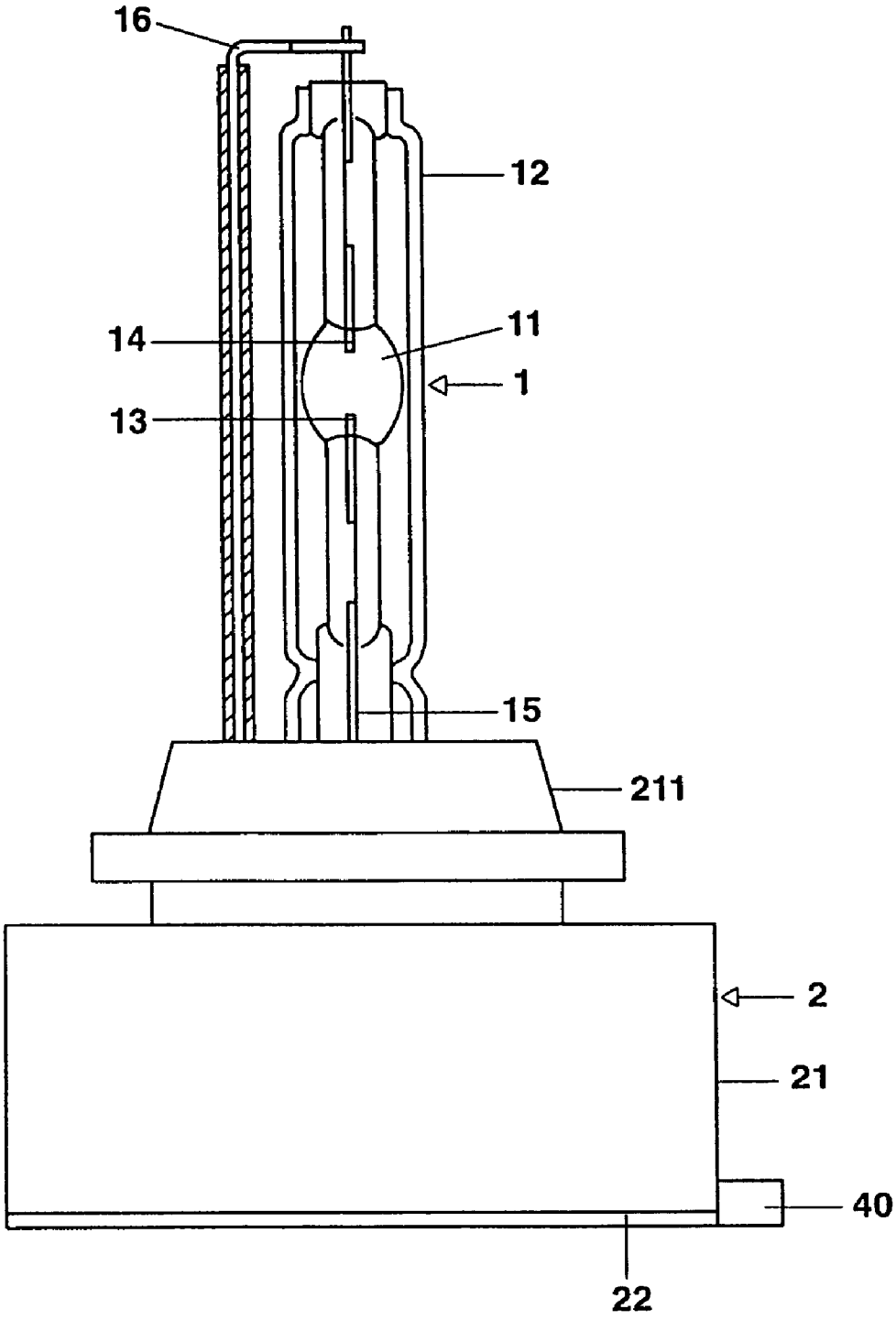

The invention is explained in more detail below with reference to a preferred exemplary embodiment. In the drawing:

FIG. 1 shows a cross section through the plug socket of the lamp base of a high-pressure discharge lamp according to the preferred exemplary embodiment of the invention, FIG. 2 shows a side view of the plug socket depicted in FIG. 1 once it has been mounted on a mounting plate, FIG. 3 shows a plan view of the mounting plate and plug socket depicted in FIG. 2, FIG. 4 shows a plan view of the base outer part of the lamp base of the high-pressure discharge lamp according to the preferred exemplary embodiment, and FIG. 5 shows a side view of the high-pressure discharge lamp according to the preferred exemplary embodiment.

V. BEST MODE FOR CARRYING OUT THE INVENTION

FIG. 5 shows a high-pressure discharge lamp according to the preferred exemplary embodiment of the invention. This high-pressure discharge lamp is a metal-halide high-pressure discharge lamp having a pulse starting apparatus integrated in the lamp base. This high-pressure discharge lamp is envisaged for use as a light source in a vehicle headlamp.

The high-pressure discharge lamp has a discharge vessel 11, which is made of silica glass, is surrounded by a vitreous outer bulb 12, and has electrodes 13, 14 arranged in it for the purpose of generating a gas discharge. The electrodes 13, 14 are each connected to a power supply line 15 and 16, respectively, which is passed out of the discharge vessel 11 and by means of which it is supplied with electrical power. The module 1 which comprises the discharge vessel 11 and the outer bulb 12 is fixed in the lamp base 2. The lamp base 2 comprises a base outer part 21 and a lid 22, which closes the chambers of the base outer part 21, and a plug socket 40 for supplying a voltage to the high-pressure discharge lamp.

The base outer part 21 depicted in FIG. 4 has an essentially square cross section. The interior of the base outer part 21 is divided by means of a partition wall 213 into two chambers 214, 215 which are different in size. The smaller, first chamber 214 is provided for the purpose of accommodating a rod-core transformer (not depicted), which acts as a starting transformer for the pulse starting apparatus, accommodated in the lamp base 2, of the high-pressure discharge lamp. The remaining components of the pulse starting apparatus (not depicted) are arranged in the larger, second chamber 215. An electrical contact element is embedded in the base outer part 21. The first end 31 of the electrical contact element extends into the first chamber 214 and, once the rod-core transformer has been mounted, is welded to the high voltage-carrying starting voltage output of the rod-core transformer. The second end 32 of the electrical contact element 3, which is provided with a through-hole 33 for the inner power supply line 15 of the high-pressure discharge lamp, extends into the second chamber 215. Provided in the base outer part 21 is a trough 2171 which is delimited by a hollow-cylindrical web 217. The second end 32 of the contact element forms part of the base of the trough. Once the inner power supply line 15 has been welded to the second end 32 of the contact element, the trough 2171 is filled with an electrically insulating sealing compound, with the result that the welded joint between the two lamp components 15, 32 is embedded in the sealing compound. The end, which is fed back into the base 2, of the outer power supply line 16, which protrudes from the end of the discharge vessel 11 which is remote from the base, extends into the hollow-cylindrical web 218, which is likewise integrally formed on the base outer part 21. Further hollow-cylindrical webs 219 serve the purpose of fixing the plug socket 40 illustrated in FIGS. 1 to 3 which serves the purpose of connecting a voltage source to the high-pressure discharge lamp.

The plug socket 40 has a housing 41, which is in the form of a plastic injection-molded part and is made of polyamide. Three metallic contact pins 42 are embedded in the material of the housing 41 and form the electrical terminals of the high-pressure discharge lamp. In each case one end 421 of the contact pins 42 is soldered to a conductor track of the mounting plate 50. The respective other end of the contact pins 42 is accessible to a plug through the opening 45 in the plug socket 40. The housing 41 has two integrally formed first pins 43 engaging in circular-cylindrical perforations in the mounting plate 50, which are matched to said pins 43 such that they fit, and forming a plug connection with said pins 43. In addition, the housing 41 has two integrally formed second pins 44, which engage in the hollow-cylindrical webs 219 of the base outer part 21, which are matched to said pins 44 such that they fit. The webs 219 have a circular-cylindrical geometry. Both the first 43 and the second pins 44 are in the form of hexagon pins. They form a plug connection with the corresponding circular-cylindrical recesses in the mounting plate 50 and with the hollow-cylindrical webs 219, respectively. The base outer part 21 has a recess for the plug socket 40 in a side wall 2151 and in the region of the webs 219. The shape of the mounting plate 50 shown in FIGS. 2 and 3 is matched to the cross section of the second chamber 215 such that it fits. The mounting plate 50, once it has been mounted, closes the chamber 215. The modules (not depicted) arranged on the mounting plate 50, such as the starting capacitor and the spark gap of the pulse starting apparatus, for example, protrude into the second chamber 215. The web 218 of the base outer part 21 is equipped with a bearing face 2181 for the mounting plate 50. The end of the power supply line 16, which extends in the web 218 and is remote from the base, is welded or soldered to the metal contact 52, which is in the form of an annular disk and is integrated in the mounting plate 50. For this purpose, the internal diameter of the annular metal contact 52 or its annular opening 53 is matched to the thickness of the power supply line 16. Two webs 220 which are integrally formed on the base outer part 21 engage in perforations 51, which are correspondingly matched to said webs 220, in the mounting plate 50 and form a plug connection with said perforations.

Guide means 2142, 2131, 2144 for the rod-core transformer are provided in the side walls 2151, 213 and the base of the first chamber 214. The lid 22 covers the mounting plate 50 and closes the two chambers 214, 215 of the base outer part 21.

What is claimed is:

1. A lamp base assembly for a high-pressure discharge lamp comprising:

a mounting plate for electronic modules and a plug socket for connecting a voltage source to the lamp base, and an exterior housing for the mounting plate;

wherein said plug socket is in the form of a surface-mounted module on said mounting plate;

wherein the plug socket includes a plastic housing formed from an injection molded plastic; a contact pin, the contact pin molded in the plastic housing and having a first end for electrical connection to the mounting plate, and a second end for electrical connection to the voltage source; and the plug socket further including a first mounting pin, and a second mounting pin;

wherein the plug socket butts against the mounting plate and the first mounting pin is coupled to the mounting plate to position and retain the plug socket relative to the mounting plate;

wherein the second end of the contact pin is soldered to the mounting plate for electrical connection;

wherein the mounting plate is positioned in the exterior housing to enclose the mounting plate; and wherein the second mounting pin is coupled to the exterior housing to position and retain the plug socket relative to the exterior housing.

* * * * *